US005699948A

United States Patent [19]

Lee

[11] Patent Number: 5,699,948

[45] Date of Patent: Dec. 23, 1997

[54] ADJUSTING MEANS FOR USE IN A STAPLE GUN

[76] Inventor: Cheng-ho Lee, No. 74, Paokao Rd., Hsintien City, Taipei Hsien, Taiwan

[21] Appl. No.: 767,442

[22] Filed: Dec. 16, 1996

[51] Int. Cl.[6] ..... B25C 1/14

[52] U.S. Cl. ..... 227/10

[58] Field of Search ..... 227/8, 9, 10, 11, 227/130

[56] References Cited

U.S. PATENT DOCUMENTS 4,153,192 5/1979 Jochum ..... 227/10
4,382,533 5/1983 Buechel et al. ..... 227/10
4,883,212 11/1989 Philipp ..... 227/9
5,029,744 7/1991 Pai ..... 227/10
5,170,922 12/1992 Ehmig et al. ..... 227/10

*Primary Examiner*—Scott A. Smith
*Attorney, Agent, or Firm*—Watson Cole Stevens Davis, P.L.L.C.

[57] ABSTRACT

An adjusting mechanism for use in a staple gun includes an adjuster which is movably received within a slot defined in an outer tube and communicating with a chamber thereof, such that the movement of the adjuster will change the space within the chamber and therefore alter a thrust generated by an explosion of cartridge and which impacts agsinst a staple releasably received within the staple gun.

2 Claims, 3 Drawing Sheets

ADJUSTING MEANS FOR USE IN A STAPLE GUN

FIELD OF THE INVENTION

The present invention generally relates to an adjusting means for use in a staple gun, and more particularly to an adjusting means which is able to increase/decrease a pressure generated from the staple gun.

BACKGROUND OF THE INVENTION

Staple guns have been widely used in the field of interior decoration. The staple gun, for example, is used to fire staples into ceilings to fix frameworks for suspending ceilings rigidly to concrete walls or securing other decorations thereto. Conventional staple guns use gun powder as a source to fire a piston received within a barrel, and the piston carrying the thrust from the gun powder will then impact against a staple also received within the barrel yet in front of the piston, thus, the staple will be fired out of the barrel. For the sake of gaining a maximum thrust from the explosion of the gun powder and thus having the best piercing effect, users often carry lots of staples of different sizes which results in inconvenience. From the previous description, it is noted that a staple gun which requires the user to carry a lot of different staples of different sizes will no longer meet the requirement of convenience.

Thus, a staple gun having an adjusting means movably received within a chamber thereof and constructed in accordance with the present invention tends to mitigate and/or obviate the aforementioned problems.

SUMMARY OF THE INVENTION

The main objective of the invention is to provide an adjusting means for use in a staple gun. The adjusting means movably received within a chamber of the staple gun is provided to alter a space of the chamber, so that when a cartridge disposed within the chamber is struck by a firing pin of the staple gun, a pressure generated by an explosion of the cartridge will consequently be changed and therefore a thrust to a staples is varied. By providing different thrusts according to staples having different sizes, a staple gun having an adjusting means movably received within the chamber is able to satisfactorily accomplish the work and meet the requirement of convenience.

Another objective of the invention is to provide an adjusting means for use in a staple gun which is able to use staples of different sizes according to the situations of the working site.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
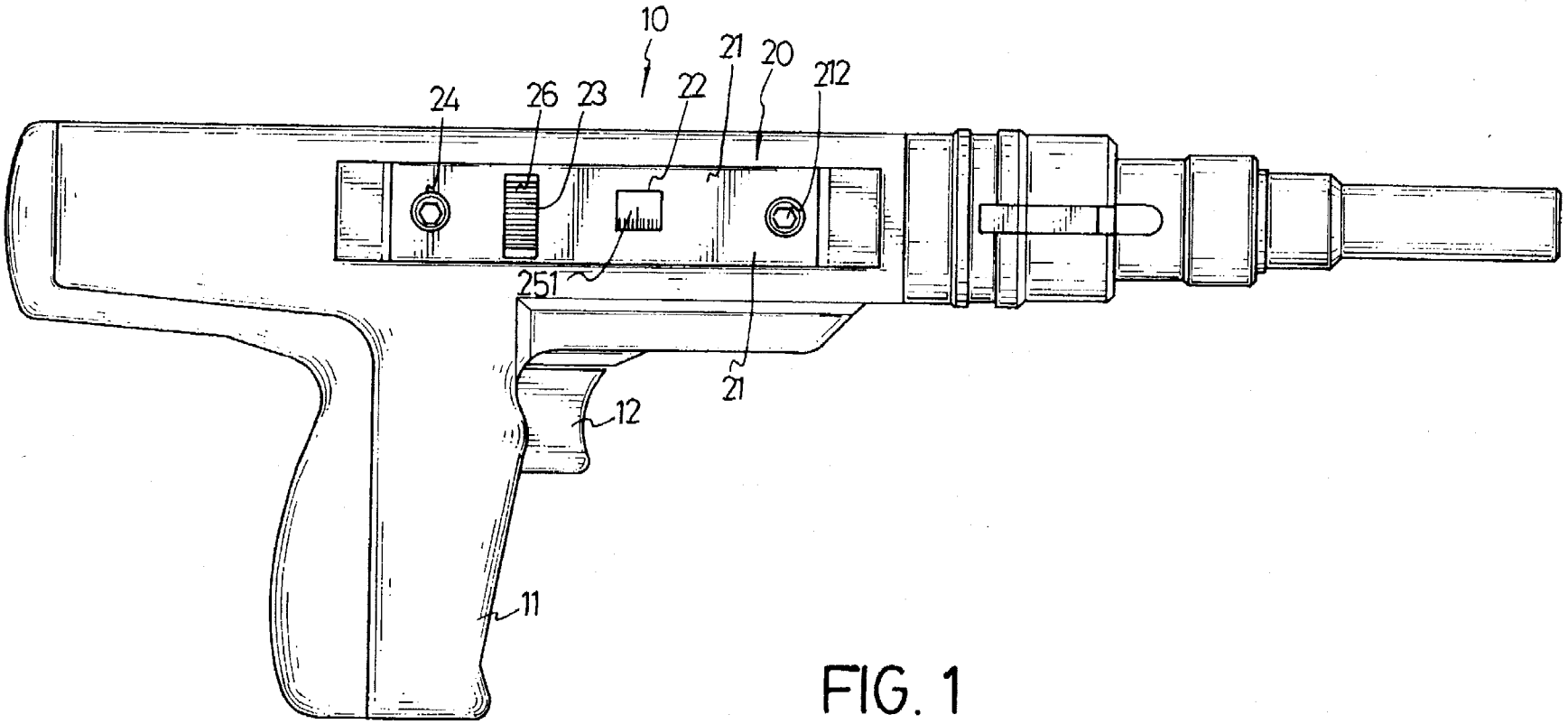
FIG. 1 is a schematic side view of the invention.

Referring to FIG. 1, a staple gun 10 constructed in accordance with the invention is shown. The staple gun 10 extends downward to integrally form a handle 11 and is further provided with a trigger 12 for controlling a movement of a firing pin (not shown or numbered). Since most parts of the staple gun 10 are constructed the same as those of prior art, detailed description of the structure of the staple gun 10 will not be necessary. Yet, it is to be noted that an adjusting means 20 is mounted on an outer surface of the staple gun 10. The adjusting means 20 includes a seat 21 securely mounted onto one side face of the staple gun 10, a window 22 fixedly situated on the seat 21, an adjusting knob 26 received within a first hole 23 which is defined in the seat 21 and near the window 22 and two second holes 24 respectively defined in a front end and a rear end of the seat 21 for respectively receiving a screw 212 therein.

Figure 2:
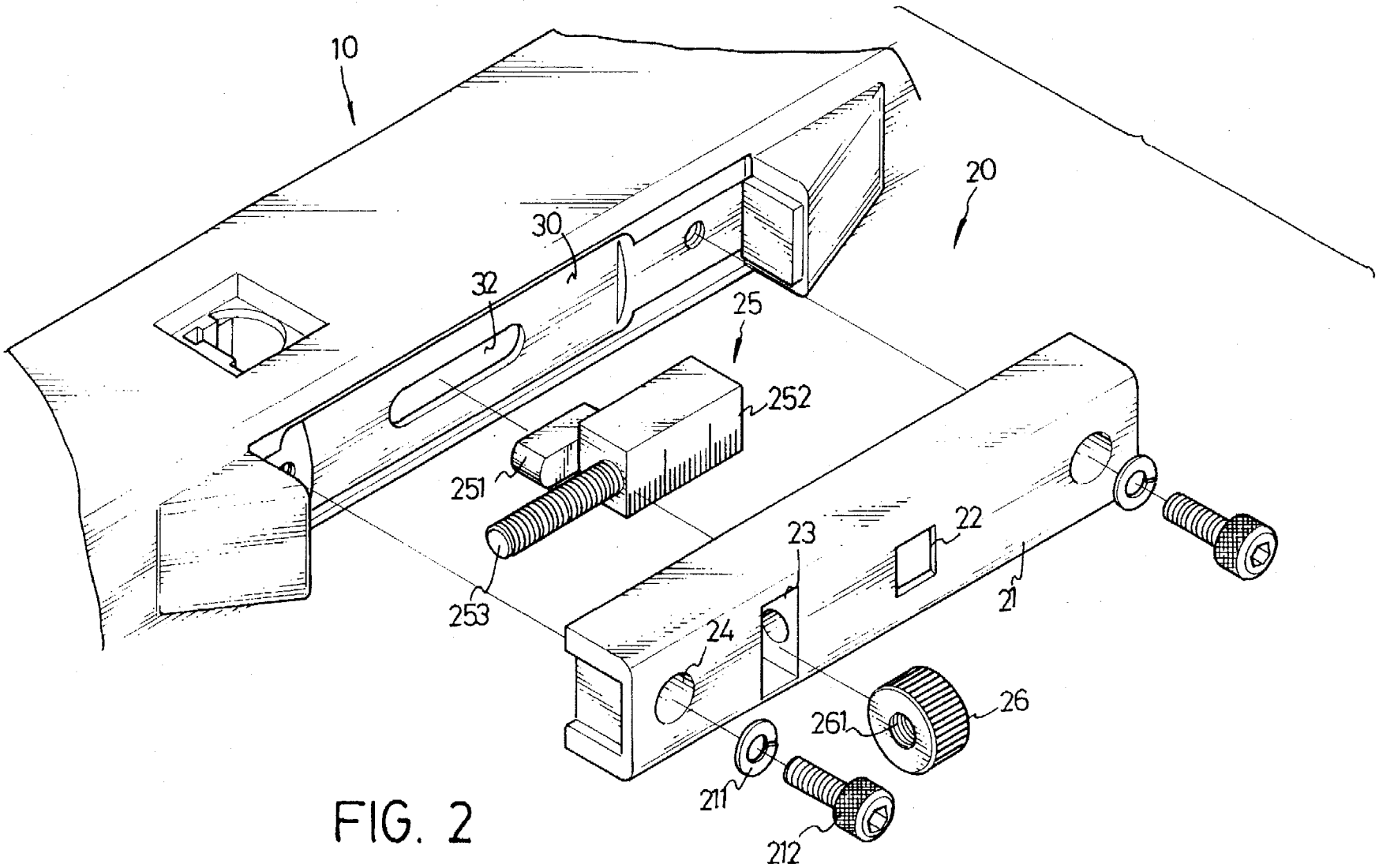
FIG. 2 an exploded view of an adjusting means of the invention.

Referring to FIG. 2, the adjusting means 20 is securely mounted onto one side face of the staple gun 10 by threadingly inserting the two screws 212 through the second holes 24 of the seat 21 into a corresponding pair of screw holes (not numbered) defined in the staple gun 10 with two spring washers 211 respectively received between the screw 212 and the second hole 24. An indicating block 25 comprising an adjuster 251 and an indicator 252 is mounted on an outer tube 30 of the staple gun 10 by disposing the adjuster 251 within a slot 32 defined in the outer tube 30. A threaded rod 253 mated to a screw bore 261 defined in the adjusting knob 26 is integrally formed on one end of the indicator 252, such that when the adjusting knob 26 is received within the first hole 23 and the indicator 252 is received within a space (not shown or numbered) defined within the seat 21 with the threaded rod 253 inserted into the screw bore 261 of the adjusting knob 26 and threadingly engaging therewith, turning the adjusting knob 26 will move the indicating block 25 to move forward or backward relative to a rear end (not numbered) of the staple gun 10.

Figure 3:
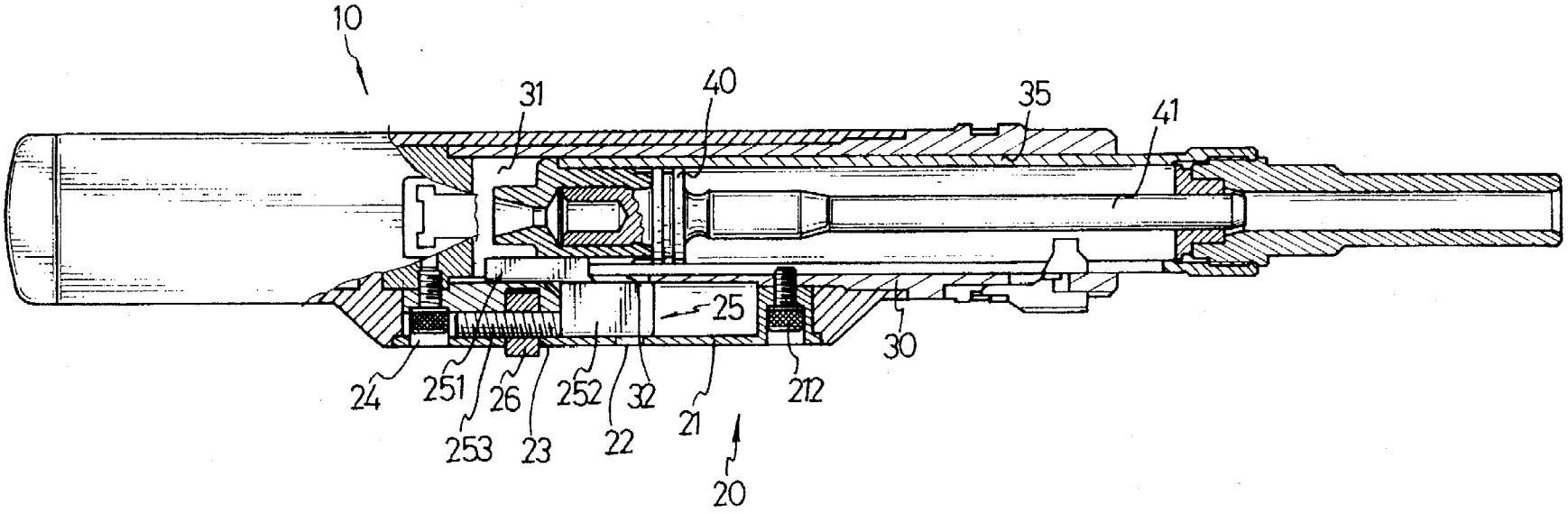
FIG. 3 is a top cross sectional view of a staple gun having the adjusting means securely disposed therein.

Referring to FIG. 3, it is noted that a piston 40 is movably received within an inner tube 35 of the staple gun 10 and a driving rod 41 is securely connected with an end of the piston 40. A chamber 31 is defined at a rear end of an outer tube 30. The outer tube 30 encases the inner tube 35, therefore, due to the forementioned assembly of the adjusting means 20 to the staple gun 10, the adjuster 251 will protrude into the chamber 31 via the slot 32 of the outer tube 30. Accordingly, the movement of the adjuster 251 of the indicating block 25 will decide the volume of the chamber 31 whenever the adjusting knob 26 is turned by a user. From the preferred embodiment of FIG. 3, it is to be noted that the adjuster 251 is in the left-most position within the chamber 31 so that the remaining volume of the chamber 31 is minimum and that the thrust generated by the explosion of the cartridge and acted onto the staple (not shown) will be maximum. The thrust will thus be gradually decreased while increasing the volume of the chamber 31 by adjusting the adjusting knob 26 which is securely and threadingly connected with the threaded rod 253. Furthermore, the marks (not numbered) on the indicator 252 will be seen from the window 22 once the indicating block 25 is received properly within the slot 32 of the outer tube 30 and the space (not shown) of the seat 21. A user is able to adjust the thrust to the staple according to different features of the working environment and there is no need to bring a lot of different staples of different sizes any more, which saves a lot of trouble for the user.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. An adjusting means for use in a staple gun comprising an inner tube having a driving rod and a piston movably received therein, said piston being securely connected with one end of said driving rod;

an outer tube having a slot defined therethrough and a chamber integrally defined in an end thereof and communicating with said slot, said inner tube being fixedly encased within said outer tube;

an adjusting knob;

a seat securely mounted onto said outer tube and having a space and a first hole defined therein; and an indicating block having an indicator securely and tightly received within said space of said seat, an adjuster integrally formed with said indicator and movably received within said slot of said outer tube and a threaded rod integrally formed with said indicator and threadingly connected with said adjusting knob.

2. The adjusting means for use in a staple gun as claimed in claim 1 further having a window defined in said seat and communicating with said space of said seat, whereby a part of said indicator is exposed from said window.

* * * * *